United States Patent [19]

Gefroh et al.

[11] Patent Number: 4,876,833

[45] Date of Patent: Oct. 31, 1989

[54] ACCESSIBLE AREAWAY SYSTEM

[75] Inventors: James A. Gefroh; Fredric J. Hattman, both of Fort Collins, Colo.

[73] Assignee: RM Base Company, Fort Collins, Colo.

[21] Appl. No.: 323,351

[22] Filed: Mar. 14, 1989

[51] Int. Cl.[4] ..... E04F 17/06

[52] U.S. Cl. ..... 52/107

[58] Field of Search ..... 52/169.6, 107, 20, 19, 52/169.7

[56] References Cited

U.S. PATENT DOCUMENTS

| | | | |
|---|---|---|---|
| 300,654 | 6/1884 | Smith | 52/107 |
| 1,695,810 | 12/1928 | Magill | 52/107 |
| 1,803,091 | 4/1931 | Bemis | 52/107 |
| 1,840,397 | 1/1932 | Keyes | 52/107 |
| 2,162,628 | 6/1939 | Martin | 52/107 |
| 2,237,564 | 4/1941 | Keyes | 52/107 |
| 2,308,131 | 1/1943 | Wellnitz | 52/107 |
| 2,316,712 | 4/1943 | Prince et al. | 52/107 |
| 2,453,609 | 11/1948 | Whitehouse | 52/107 |
| 2,695,689 | 11/1954 | Peterson | 52/107 |
| 2,761,180 | 9/1956 | Krelwitz | 52/107 |
| 3,004,634 | 10/1961 | Evans et al. | 52/107 |
| 3,608,252 | 9/1971 | Bisson . | |
| 3,844,076 | 10/1974 | Schlick | 52/107 |
| 3,848,378 | 11/1974 | Witte | 52/169.7 |
| 3,999,334 | 12/1976 | Webb | 52/20 |
| 4,226,062 | 10/1980 | Doane | 52/169.6 |
| 4,330,500 | 5/1982 | Mackes | 52/107 |

OTHER PUBLICATIONS

National Fire Protection Association Life Safety Code Book, Chaper 22, pp. 945–958, and Chapter 30, pp. 1133–1137.

Uniform Building Code, 1985 Edition, Chapter 12, pp. 71–73 and Appendix p. 743, and Chapter 33, pp. 554–565.

Scientific American, published Nov. 27, 1886, p. 344.

*Primary Examiner*—James L. Ridgill, Jr.

*Attorney, Agent, or Firm*—Luke Santangelo

[57] ABSTRACT

An areaway allowing for escape or for ingress and egress in emergency situations is disclosed. A unitary body is designed for attachement to the exterior of a foundation wall. This unitary body includes steps to facilitate escape and may include openings to access the earth below the areaway and for planting. In such fashion both maintenance of the areaway and its aesthetic appeal are enhanced. Additional features allow for improved access for escape and improved drainage of the areaway. The unitary design may be molded and may include a cover, integral lights, or even simply a vertical retaining wall with molded steps to accommodate existing designs. The areaway allows aesthetic use of the space within it.

26 Claims, 4 Drawing Sheets

ACCESSIBLE AREAWAY SYSTEM

BACKGROUND OF THE INVENTION

Generally this invention relates to the field of areaways, the enclosures for basement windows. More specifically, the invention relates to areaway escape systems. The invention also concerns improvements to areaway designs which allow the space within an areaway to become useful and appealing to residential and commercial users.

For more than a century the technique of allowing light in through a basement window has existed in order to make the space more desirable and made it meet other requirements. In large part the technique has been accomplished through the use of an areaway to surround the bottom and sides of the basement window to hold earth away from the window so that light can be admitted. An early effort in this regard is shown in U.S. Pat. No. 300,654 to Smith for an "area window protector" first patented in 1884. Many other areaway designs and improvements have been patented since that date. In almost every one of these designs, the focus has been to provide a design which admits light and which excludes earth. The latter of these goals has been met with varying degrees of success. Often elaborate designs have been proposed, including some which are formed as an integral part of the foundation surrounding the basement window. Even with such elaborate designs, none have been entirely effective in completely excluding the earth surrounding the areaway and none have sought to utilize the volume outside the basement window and within the areaway. Generally, this volume has been ignored by those skilled in the art of areaway design. It has apparently been viewed as "a necessary evil" or simply an area which needs to be open in order to admit the desired light.

In recent years it has been discovered that the areaway was also useful as an escape avenue in the event of fire or some other catastrophe. U.S. Pat. No. 3,999,334 to Webb describes an areaway entitled "Webb Basement Window Escape." Although not a true areaway but an extension of basement space beyond the foundation wall, this 1976 patent appears to be the first to recognize that the basement window could be useful as a means of escape. Although—with the benefit of hindsight—it may at first glance appear surprising that it took almost 92 years to improve a product similar to an areaway to allow it to become a means of escape, this delay makes sense when it is understood that those skilled in the art of areaway construction tended to improve existing designs in small degrees rather than to freshly innovate to overcome undesirable limitations. This is why until the present invention the seemingly simple combination of allowing for an escape system and utilizing the space within the areaway for aesthetic and practical purposes has not been proposed. Those skilled in the art were usually primarily practical people who sought to overcome one perceived problem rather than people who completely re-thought areaway systems.

The present invention focuses on the desirability to allow not only additional safety features to be incorporated within an areaway, but also to provide some designs which, rather than ignoring the space within the areaway, make that space useful to occupants of the building. In addition to achieving these goals, embodiments of the present invention have been designed with features that accommodate the perspectives of not only the consumer, but also the supplier, the installer, and the manufacturer.

In addressing each of the various perspectives of those involved with the product from its manufacture through its replacement, various independent desires have been accommodated. With respect to the consumer, the present invention allows for an aesthetic use of space and for additional safety features as mentioned. In addition, the design avoids the difficulties of maintaining the space and providing for drainage inside the areaway. With respect to both the supplier and the manufacturer, the design allows for a unitary construction which is not only easily manufactured, but which can be nested for shipping and storage. With respect to the installer, the design avoids any need to integrate the areaway with the foundation so that simple installation and, perhaps more commercially significant, simple replacement can be accomplished. In this fashion the design is adaptable to both existing structures and even to replacement of existing areaways. Prior to the present invention, no solution to these various goals was accomplished by any one areaway design.

Another key element to some embodiments of the present invention was the recognition that in earlier inventions it was assumed that exclusion of earth from the areaway was a desirable feature. The present invention overcomes this perceived limitation and avoids the need for many of the features inherent once such a goal is assumed. This is accomplished by not only avoiding any extraordinary measures to exclude earth, but through actually creating features which allow access to the earth from within the areaway. This change is simple only after hindsight. Prior to the present invention those skilled in the art would have no doubt felt that providing open access to the earth would be highly undesirable. Prior to the present invention, those skilled in the art simply taught away from allowing for access to the earth from within the areaway, just as prior to the Webb invention described in U.S. Pat. No. 3,999,334 they had taught away from use of the areaway as a means for escape. On this latter aspect the present invention actually enhances the safety features mentioned in Webb by making them more practical and safer for the occupant in an emergency or panic situation. It also allows for access by emergency personnel and provides a design which can be easily and economically retrofitted to the exterior of existing structures. Attempts by those skilled in the art were simply inadequate because they assumed that the problem of excluding earth was critical to commercial success of an areaway and because means of escape required integration with the foundation. Instead, the present invention discloses the realization that access to the earth is not only desirable from an installation perspective, but also from the consumer's perspective as well and that escape can be provided without modification of the existing foundation. The degree to which these seemingly simple recognitions are significant seems apparent when one considers that the present invention, although unexpectedly simple in achieving these goals and overcoming the limitations of the prior art, has not been available even though areaways have existed for over one hundred years.

SUMMARY OF THE INVENTION

It is broadly an object of the present invention to provide a design which utilizes the existing space within the areaway. It is an object to maximize the usefulness of this space without interfering with the desired features of existing areaways. An object is thus to allow for such space to be used in an aesthetically pleasing manner which actually enhances the basic purpose of a basement window namely making the basement space more livable.

It is a further object of the present invention to provide a design which allows for escape features in an areaway which can be easily retrofitted to existing structures. An object is also to provide a design which can be easily installed in new structures. An object of the design is not only to provide for escape, but also to provide for access by emergency personnel through the areaway. Such access is provided in a useful fashion which accommodates the inherent equipment and needs of such emergency personnel.

It is a further object of the present invention to provide for designs which accommodate the various perspectives of those persons coming in contact with the areaway. Such perspectives include the perspectives of manufacturer, supplier, builder, installer, building owner, occupant and emergency personnel. An object of the present invention is to accommodate each of these perspectives in one simple design which balances the various competing interests.

It is a further object of the present invention to provide for an areaway design which allows access to the earth surrounding the areaway. An object of the present invention is to provide a design which allows planting within the areaway.

It is a further object of the present invention to simplify the installation of areaway escape systems. An object is thus to accommodate new structures and to allow for easy replacement of existing areaways. An object is also to simplify installation by allowing for access to the earth surrounding the areaway from within the areaway itself. An object is thus to avoid having to install the areaway and backfill from behind the areaway after it has been attached to the structure. Another object is to provide a design which does not require modification to the existing structure in order to accomplish installation of the areaway escape system. It is thus an object to allow for installation which is easy enough to be accomplished by a homeowner in residential applications.

It is a further object of the present invention to provide an escape system which is outside the living space of a building. An object is to provide an areaway which need not be integrated into the foundation of a building and which may be separated from the interior space of the building through existing windows and the like. A further object is to accommodate conventional gradings and slopes away from the structure.

A further object of the present invention is to allow for nesting of the areaway escape system to simplify storge and transportation of the areaways prior to installation. Similarly an object is to provide for a device which may be simply manufactured which also achieves the various aims mentioned.

Naturally, further objects of the invention are disclosed throughout other areas of this specification and claims.

DETAILED DESCRIPTION OF THE PREFERRED EMBODIMENTS

Figure 1:
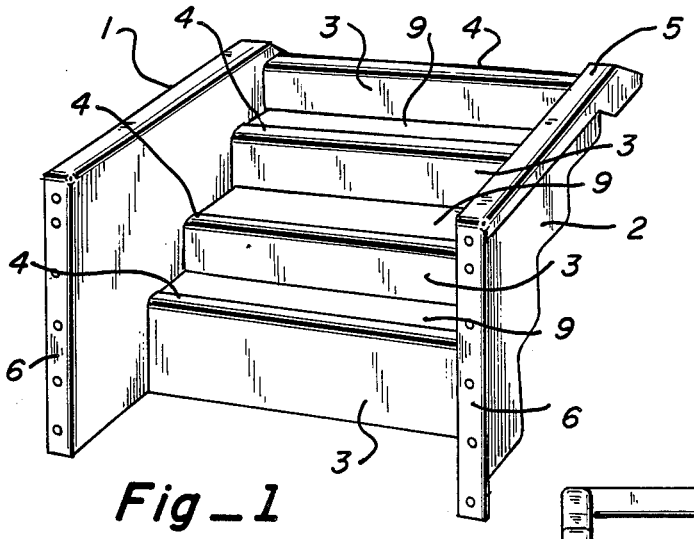
FIG. 1 is a perspective view of an embodiment of the invention.

As can be seen from the drawings, the basic concepts of the present invention may be embodied in many different ways. FIG. 1 shows one embodiment of the invention in perspective. Unitary body (1) incudes side members (2) and a back which includes vertical back elements (3) and horizontal back elements (4). Upper flange (5) provides structural support through its U-shape, but may be of any number of a variety of designs. By providing a body which is unitary, manufacturing and cost efficiencies are gained allowing the invention to meet the objects of an efficient, cost effective design from various perspectives. Not only is manufacturing more easily accomplished, but it can be accomplished in a less expensive manner. Equally important, installation and transportation are greatly facilitated.

An important feature of the areaway is that it be designed to attach to the exterior of the foundation of a building without significant alteration of the foundation. This is accomplished through foundation flanges (6). Although designs for an areaway escape system have required significant alteration of the foundation, the present invention affords easy attachment to the foundation by providing numerous holes in foundation flanges (6) so that height and attachment may be easily adjusted and accomplished. This allows utilization of the present invention in situations where prior areaways are replaced. In the Webb invention mentioned earlier, replacement usage is not easily accomplished. Since that design forms a part of the interior space of the building, adaptation of the foundation, radical change to building grading and backfilling, and adaptation of the basement window would be necessary to utilize that design in existing buildings. Since the foundation primarily provides structural support for the building, replacement uses would be very difficult to accomplish. Even if used in new construction, the Webb design would require radical modification of foundation forming and changes to exterior backfill grading and the final appearance of the structure. These limitations are addressed in the present invention. The area between foundation flanges (6) forms a vertical opening which would be adjacent to the foundation face when installed. Such an opening may be sized to accommodate existing window structures.

Figure 2:
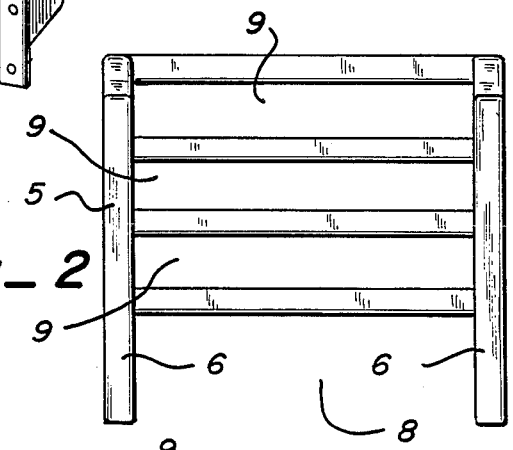
FIG. 2 is a top view of the embodiment shown in FIG. 1.

A feature of the present embodiment is the fact that bottom edge (7) of unitary body (1) creates floor opening (8). Floor opening (8) may serve as a drain for the areaway. In providing an open area rather than a fixed drain design, users and installers of the areaway can incorporate any particular type of drain mechanism they desire. For instance as shown in FIG. 2, a "french drain" design is disclosed. In addition, concrete floors even with plumbed drains or planting are certainly possible through this feature of the present embodiment, the essence of such a feature being that it can accommodate a broad variety of drain designs. In addition to the floor drain, it can be seen that vertical and horizontal back elements (3 and 4) form steps within the areaway as an escape means. On the top of each step, at each horizontal back element (4), an opening is provided. This opening serves not only as an additional drain mechanism, but also as a means for accessing the earth below the areaway and as a means for planting within the areaway.

Referring to FIG. 2, a top view of the embodiment shown in FIG. 1, it can be seen that these openings form a substantial amount of the area of each horizontal back element (4). Although simple provision of a small drain tube could be utilized, by providing an opening which is larger than that merely necessary to allow water drainage, the present invention accommodates several needs. The provision for such an opening throughout the areaway is a significant departure from the prior art as prior to the present invention those skilled in the art felt that in order to be commercially acceptable areaways must exclude earth to the largest extent possible. As an example, U.S. Pat. No. 2,453,609 for an "Areaway Wall" states that it relates to walls which define an areaway and which prevents substantially all infiltration of earth into the areaway. Although at first it might seem like a simple modification to depart from this preconception, those skilled in the art had simply not questioned the need and thus were limited in their designs.

The step openings (9) not only serve as a means for draining the areaway, but also to allow proper installation and planting within the areaway. By allowing access to the earth behind the areaway through step openings (9), installation is greatly facilitated. While excavation of the earth surrounding the foundation of a house is necessary, once the areaway is installed the problem of backfilling the earth was difficult for areaways which were not simply vertical walls. Since support of the areaway by the earth is a very beneficial structural aspect, backfilling under the areaway was a problem for designs such as that shown. The present invention solves this problem through step openings (9). After attachment of unitary body (1) to foundation (10) through foundation flanges (6), the installer may then simply backfill the areaway through step openings (9). This allows for proper compaction and enhances the structural and support needs of the areaway thus minimizing the torsion on foundation flanges (6). This is significant because it allows the implementation of a simple escape device in situations where prior art had required involved measures including even reconstruction of edges of the foundation.

In addition, step openings (9) also allow the capability of planting within the areaway. Although most areaways serve solely to admit light and in so doing create a volume of space which is basically undesirable, by allowing planting within the areaway, the present embodiment enhances the aesthetic appeal of the areaway and even integrates the volume of space within the areaway into the aesthetic surroundings of the interior living area. In the present invention this volume of space is not integrated as part of the interior living area. This is significant in that it allows the areaway to be incorporated in existing designs where basement windows are utilized with minimal or no modification.

As can be seen in FIGS. 1 and 2, side members (2) are slightly tapered to permit nesting of units when being stored or transported. This feature is a practical concern for both the manufacturer and the supplier. Certainly a variety of nesting aspects could be included such as tapers on other surfaces or curved wall members and still be within the scope and spirit of the present invention.

Figure 3:
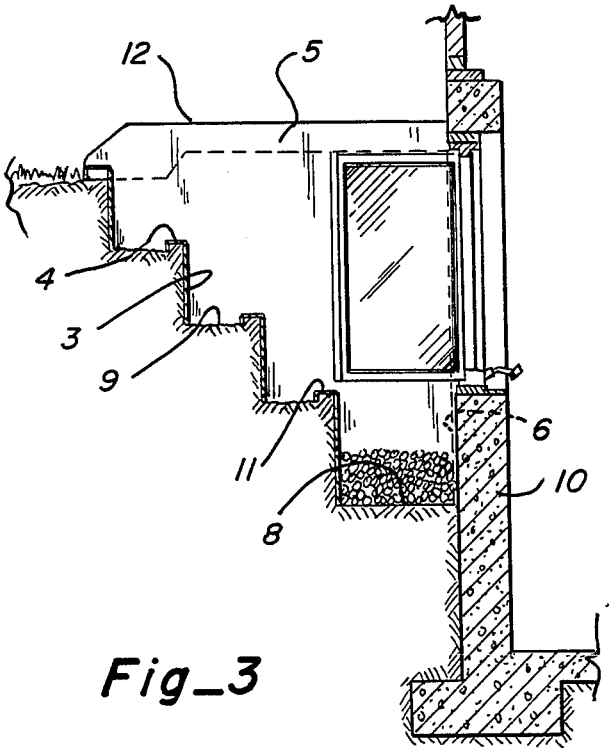
FIG. 3 is a cross-sectional side view of the embodiment shown in FIG. 1 as it would look when attached to a foundation.

Referring to FIG. 3, a side view of the same embodiment, additional features of the areaway can be understood. As can be seen, the areaway is attached to the foundation (10) at foundation flanges (6). Such attachment may be through any number of means including bolting the areaway directly to foundation (10). Since present areaways often utilize similar flanges, attachment is easily accomplished when replacement is accomplished. Floor opening (8) is shown with a "french drain" having gravel inserted at the bottom. Upper flange (5) can be seen to extend above the top horizontal back element (4). In accordance with building codes and design criteria, upper flange (5) is of sufficient height to accommodate standard slope grades for proper drainage away from the building.

A further feature of this embodiment is the fact that the lowest horizontal back element (11) may be designed to be lower than the bottom edge of a basement window after installation. This allows additional space for opening the window in the event casement or other such designs are utilized. Such a window is shown in the open position in FIG. 3.

In providing a series of open steps, the present embodiment allows a positive means for escape through the areaway. In addition, by providing a relatively wide floor opening (8) and by providing a large upper opening (12), the areaway allows not only for egress from the building but also for ingress as may be necessary for emergency personnel. This aspect is significant because the majority of areaway designs are not sufficiently wide to allow rescue operations through the opening. Certainly this would include the ability to wear oxygen tanks and carry similar equipment into the structure through the areaway. Such operations and the recognized need for access from the exterior has been the subject of indirect comments by the National Fire Protection Association. Prior to the present invention, however, these needs have not been met.

As mentioned earlier, a unitary body construction is preferred. In the preferred embodiment, manufacture can be easily accomplished through spraying a material such as fiberglass or plastic on a wooden mold with some type of coating. Naturally, color, fiberglass particles, and other aspects can be included. Additional thickness can be easily provided at areas needing enhanced structural integrity. Certainly other manufacture methods are possible including resin transfer, vacuforming and even injected molding.

Figure 4:
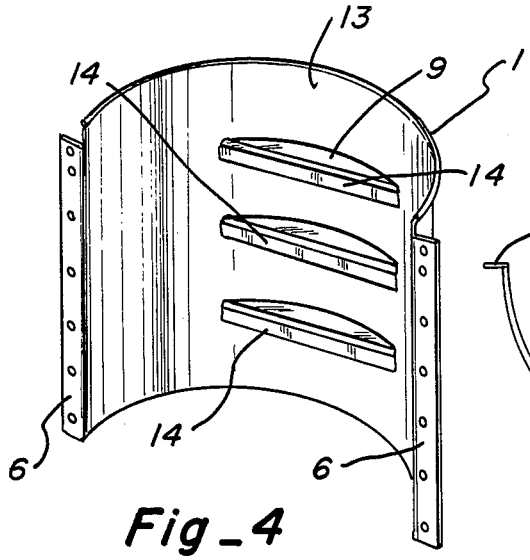
FIG. 4 is a perspective view of another embodiment which includes a substantially vertical retaining member.

Referring to FIG. 4, another embodiment of the present invention can be seen. FIG. 4 presents a simplified embodiment which provides for a means of escape in an areaway which may be easily retrofitted to existing designs without modification of the foundation. Such attachment is accomplished as before through foundation flanges (6). The means for escape comprises a series of vertical steps which are molded into a substantially vertical retaining element (13). These molded steps (14) may be positioned anywhere on retaining element (13) and may naturally be either positive steps as shown, or negative inserts. Since molded steps (14) extend either little or no distance beyond retaining element (13), backfill underneath each step may or may not be necessary. Step openings (9) provide a means for accessing the earth below the step. As with the previous embodiment, step opening (9) may also serve as a planting means. The embodiment may also be specifically designed to modify current areaway structures to the smallest extent possible to address users accustomed to existing designs or who prefer the features of such existing designs. In designing molded steps (14), certainly various shaping differences could be provided and yet would still fall within the scope and spirit of the present invention. Handles could be included through different molding of the steps, however, such have not been included in the present design as a most simplified version has been sought. In like fashion, retaining element (13) can have different shapes.

Figure 5:
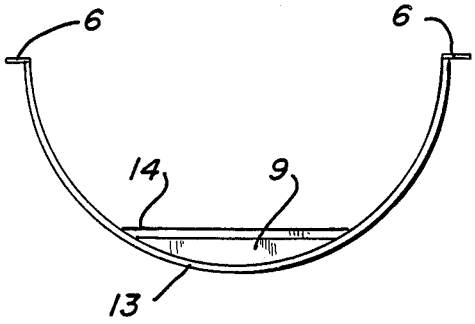
FIG. 5 is a top view of the embodiment shown in FIG. 4.

FIG. 5 shows a top view of the embodiment shown in FIG. 4. As can be seen, molded steps (14) need only comprise a sufficient amount of area to provide a positive means for escaping.

Figure 6:
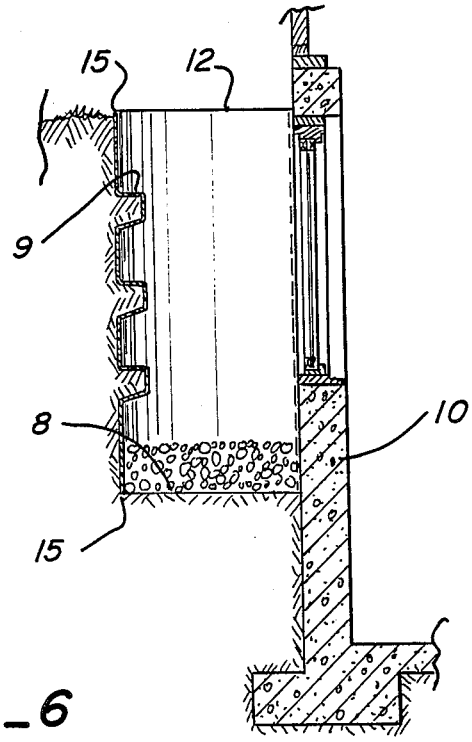
FIG. 6 is a cross-sectional side view of the embodiment shown in FIG. 5 as it would look when attached to a foundation.

As shown in FIG. 6, this embodiment may also be mounted to foundation (10) by bolting through foundation flanges (6). The bottom of the areaway created floor opening (8) which serves as a drain and may be utilized in any number of fashions as mentioned earlier. Again, a french drain is shown with gravel inserted. For structural reasons, top and bottom edge of the areaway have radiused borders (15) for additional strength. Thickening at stress areas could also be provided.

Figure 7:
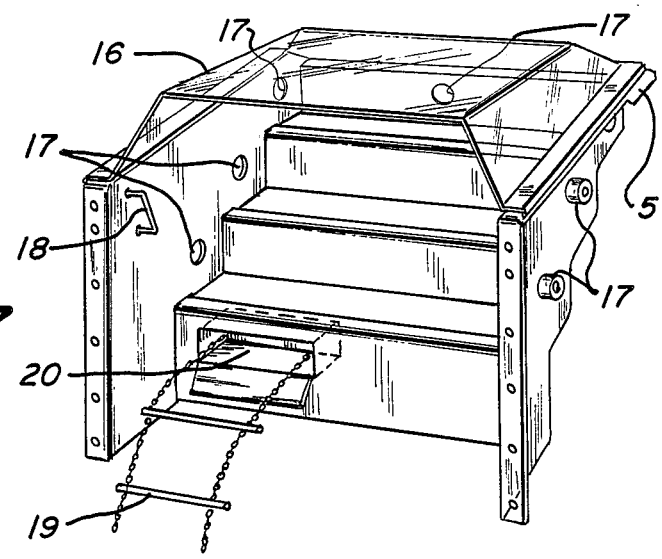
FIG. 7 is a perspective view of another embodiment which includes additional features.

Referring to FIG. 7, an additional embodiment incorporating several separate features is shown. First, an areaway cover (16) is shown over the upper opening. Areaway cover (16) not only serves the conventional purpose of excluding the elements while admitting light to the areaway, but it also enhances embodiments of the present invention which allow planting by creating a greenhouse effect. Hinging, snapping or some other attachment technique could be utilized. Certainly areaway cover (16) should not be permanently fixed to upper flange (5) as both ingress and egress in emergency situations must be allowed.

Consistent with the greenhouse possibilities and with the object of allowing the space within the areaway to become aesthetically functional, integral lights (17) are provided. Positioning of these lights, shown on side member (2) and on vertical back element (3), could be varied. The lights would serve not only to illuminate the areaway, thus adding additional light to the interior space, but also to enhance the greenhouse nature by serving as a heat or growth light source when areaway cover (16) is utilized. Certainly lights could exist without use of areaway cover (16).

As an enhancement to the means for escape, handles (18) may be added to the upper area of either or both side members (2). Handles (18) would be angled to assist a person in accessing the areaway and escaping from the interior space. Since the vast majority of basement windows are raised somewhat from floor level, handles would assist the person in extricating themselves through the basement window. In addition, a ladder (19) could be provided. While certainly ladder (19) could be stored externally and attached to the areaway or the foundation through some attachment means, ladder (19) such as a rope ladder could be integral to the areaway design through use of some compartment (20). Naturally compartment (20) could be a variety of designs, one possibility being the openable compartment as shown in FIG. 7.

Figure 8:
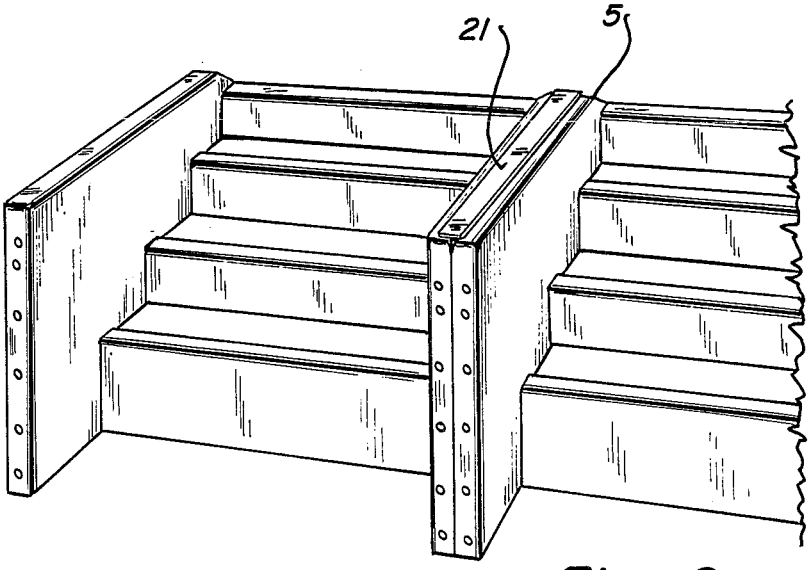
FIG. 8 is a perspective view of areaways connected in series.
Figure 9:
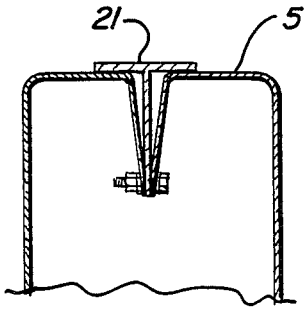
FIG. 9 is an enlarged view of the series connector as it would look when installed.

In FIG. 8 two areaways connected in series are shown. Since it may be desirable to have several basement windows, the embodiment shown lends itself to a means for connecting the areaways in a series. Series connector (21) allows units to be bolted together through exterior edges of upper flange (5) as shown in FIG. 9. Series connector (21) also serves to visually integrate the two areaways by covering the upper portion of upper flange (5) for weather and aesthetic reasons. Although series connector (21) provides a simple connection technique, certainly other connections are possible including clips, integral barbs and the like. Again, although other designs may have advantages, the preferred embodiment of series connector (21) is as shown. This type of connection has been chosen based upon the goal of providing a simple device at the outset. The use of an angular connector as shown in FIGS. 8 and 9 serves to integrate the two units and is a simple device.

Figure 10:
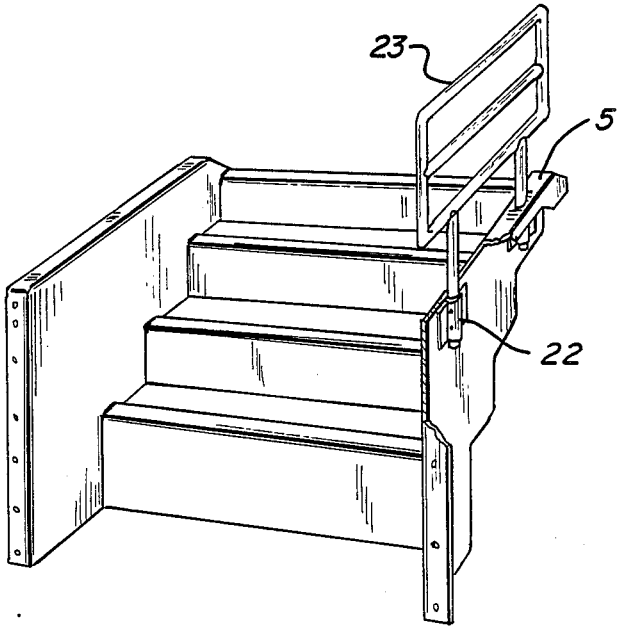
FIG. 10 is a perspective view of an embodiment in which a railing has been inserted.
Figure 11:
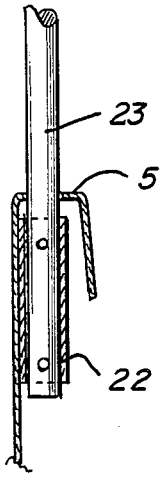
FIG. 11 is an enlarged view of the railing connection sleeve.

Since certain building codes require the use of railings to protect any fall into an areaway, a means to accommodate a railing is shown in FIGS. 10 and 11. Through well known manufacturing techniques, a mounting guide such as railing sleeve (22) can be attached to side wall (2) as shown. Railing sleeve (22) could naturally be a metal tube or any other kind of receptacle for railing (23). Railing sleeve (22) could be attached to side wall (2) through fiberglassing railing sleeve (22) to side wall (2). As shown in FIG. 11, railing could then be bolted to unitary body (1) underneath upper flange (5). Naturally, other structural enhancements could be added including additional sleeves lower on side wall (2) and the like. Railing (23) could also be designed to be detachable without bolting it from below upper flange (5).

Figure 12:
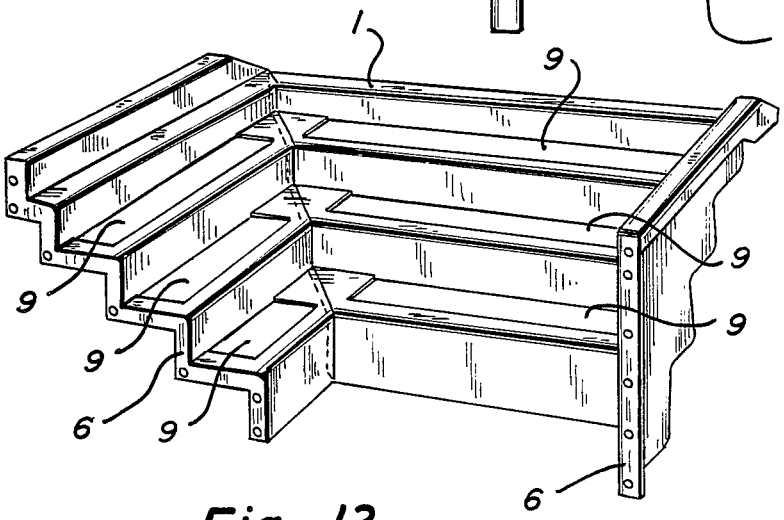
FIG. 12 is a perspective view of an embodiment having steps on one side.

Referring to FIG. 12, an areaway which includes stepped openings on at least one side is shown. Since the primary purpose of areaways has been to admit light, it may be desirable to include angled openings on one or more sides of the areaway. As shown in FIG. 12, additional step openings may be provided for additional aesthetic appeal and for the reasons mentioned earlier. Certainly such modifications are intended to fall within the scope and spirit of the present invention.

We claim:

1. An open areaway escape system for a building having: a basement window having a top and a bottom, and a foundation, said areaway escape system comprising:

a. a unitary body comprising:

(1) a wall member having a top edge, a bottom edge, and a foundation face edge;

(2) an uncovered upper opening adjacent to the top edge of said wall member;

(3) an upper flange between said uncovered upper opening and said wall member along said top edge;

(4) a vertical opening adjacent to the foundation face edge of said wall member; and (5) a floor opening adjacent to the bottom edge of said wall member.

b. a positive means for escaping;

c. a means along said vertical opening for attaching said unitary body to the exterior of the foundation of said building adjacent to said basement window without significantly altering said foundation; and d. a means for draining the areaway.

2. An open areaway escape system as described in claim 1 wherein said means for attaching to the foundation utilizes existing mounting systems.

3. An open areaway escape system as described in claim 2 wherein said wall member and said means for escaping comprise:

a. a retaining element which is substantially vertical; and b. a plurality of definite steps integral to said retaining element.

4. An open areaway escape system as described in claim 1 wherein said wall member and said means for escaping comprise:

a. a plurality of substantially vertical back elements;

b. a plurality of substantially horizontal back elements; and c. a plurality of substantially vertical side members.

5. An areaway escape system for a building having a basement window having a top and a bottom and a foundation, said areaway escape system comprising:

a. a unitary body comprising:

(1) a wall member having a top edge; a bottom edge; and a foundation face edge;

(2) an upper opening adjacent to the top edge of said wall member;

(3) an upper flange between said upper opening and said wall member along said top edge;

(4) a vertical opening adjacent to the foundation face edge of said wall member; and (5) a floor opening adjacent to the bottom edge of said wall member;

b. a positive means for escaping;

c. a means for attaching said unitary body to the exterior of the foundation of said building adjacent to said basement window without significantly altering said foundation;

d. a means for draining the areaway; and e. a means for accessing the earth below said unitary body.

6. An areaway escape system as described in claim 5 and further comprising a means for planting in the earth below said areaway.

7. An areaway escape system as described in claim 5 wherein said means for accessing comprises an open aperture in said wall member and wherein said open aperture encompasses more than an insignificant amount of area relative to the area of said wall member.

8. An areaway escape system as described in claim 4 and further comprising an open aperture in at least one horizontal back element of said wall member and wherein said open aperture encompasses a substantial portion of the area of said horizontal back element.

9. An areaway escape system as described in claim 5 wherein said means for escaping comprises a plurality of steps and wherein said means for draining comprises at least one drain on each step.

10. An areaway escape system as described in claim 9 and further comprising a means for planting in the areaway.

11. An areaway escape system as described in claims 3, 6 or 10 and further comprising a cover openability connected to said upper flange and over said upper opening.

12. An areaway escape system as described in claims 3 or 10 wherein said upper flange is designed to accommodate a cover.

13. An areaway escape system as described in claims 3 or 7 and further comprising a means for connecting a plurality of unitary bodies in series.

14. An areaway escape system as described in claim 13 wherein said means for connecting comprises an angular connector.

15. An areaway escape system as described in claims 3, 6, 8 or 10 and further comprising integral lights.

16. An areaway escape system as described in claim 15 wherein said integral lights are located on said wall member.

17. An areaway escape system as described in claims 3, 6, 8 or 10 and further comprising a railing mounted through said upper flange.

18. An areaway escape system as described in claims 3, 6, 8 or 10 and further comprising mounting holes in said upper flange for a railing and mounting guides for railing on the exterior of said wall member.

19. An areaway escape system as described in claims 6, 8 or 10 wherein at least one of said vertical side members comprises a plurality of substantially vertical side elements and a plurality of substantially horizontal side elements.

20. An areaway escape system as described in claim 8 wherein said horizontal back element closest to the bottom edge of said wall member is lower than the bottom of said basement window.

21. An areaway escape system as described in claims 1, 3, or 10 and further comprising a means for nesting said areaways when stored prior to installation.

22. An areaway escape system as described in claim 21 wherein said means for stacking comprises a taper on said wall member.

23. An areaway escape system as described in claims 3 or 10 wherein said means for escaping further comprises at least one handle attached to said wall member.

24. An areaway escape system as described in claim 23 wherein said means for escaping further comprises a ladder.

25. An areaway escape system as described in claim 24 wherein said ladder is detachable and wherein said means for escaping further comprises a means for connecting said ladder to said areaway, said means for connecting being integral to said areaway.

26. An areaway escape system as described in claim 24 wherein said ladder is a rope ladder and wherein said means for escaping further comprises a compartment for storing said ladder, said compartment being integral to said wall member.

* * * * *